US010400404B2

(12) United States Patent
Hawkins

(10) Patent No.: US 10,400,404 B2
(45) Date of Patent: Sep. 3, 2019

(54) WEAR-RESISTANT COATING

(71) Applicant: Ironhawk Industrial Distribution LLC, Euclid, OH (US)

(72) Inventor: Patrick Hawkins, Beachwood, OH (US)

(73) Assignee: IRONHAWK INDUSTRIAL DISTRIBUTION LLC, Euclid, OH (US)

( * ) Notice: Subject to any disclaimer, the term of this patent is extended or adjusted under 35 U.S.C. 154(b) by 107 days.

(21) Appl. No.: 15/418,019

(22) Filed: Jan. 27, 2017

(65) Prior Publication Data

US 2017/0211250 A1 Jul. 27, 2017

Related U.S. Application Data

(60) Provisional application No. 62/287,698, filed on Jan. 27, 2016.

(51) Int. Cl.
*E01H 5/06* (2006.01)

(52) U.S. Cl.
CPC ..... *E01H 5/061* (2013.01); *E01H 5/065* (2013.01)

(58) Field of Classification Search
CPC ..... E01H 5/061; E01H 5/065
USPC ..... 37/266
See application file for complete search history.

(56) References Cited

U.S. PATENT DOCUMENTS 422,566 A * 3/1890 Briggs ..... B28D 1/20 125/38
1,583,916 A * 5/1926 Demars ..... A01B 1/02 294/49
1,592,731 A * 7/1926 Ernest ..... A01B 19/02 172/200
3,198,565 A 8/1965 Ellis
3,408,086 A 10/1968 Bennett
4,178,012 A 12/1979 Roth et al.
4,431,209 A 2/1984 Volkl et al.
(Continued)

FOREIGN PATENT DOCUMENTS

CN 202787166 U 3/2013
DE 2403051 A1 8/1974
KR 101317693 B1 10/2013

OTHER PUBLICATIONS

Wang Huai, et al., "Biomimetic Design and Tribological Properties of Porous Lubricatin Wear-Resistance", Cailiao Gongcheng/Journal of Materials Engineering, n 6, p. 45-50, Jun. 2014, publisher: Beijing Institute of Aeronautical Materials.
(Continued)

*Primary Examiner* — Gary S Hartmann
(74) *Attorney, Agent, or Firm* — Calfee, Halter & Griswold LLP

(57) ABSTRACT

An exemplary plow includes a moldboard having a wear surface and a blade having a wear surface. A wear resistant coating is applied to at least a portion of at least one of the wear surfaces of the blade and moldboard. The wear resistant coating includes a plurality of scales. Each scale has a leading edge, a trailing edge, a raised portion disposed between the leading edge and the trailing edge, and a peak of the raised portion disposed closer to the trailing edge than the leading edge. The scales of the wear resistant coating are arranged in a plurality of rows, and gaps formed between scales in one row are offset from gaps formed between scales in an adjacent row.

17 Claims, 9 Drawing Sheets

(56) References Cited

U.S. PATENT DOCUMENTS

| | | | | |
|---|---|---|---|---|
| 4,571,860 | A | 2/1986 | Long | |
| 4,651,450 | A * | 3/1987 | York | E01H 4/02 15/236.08 |
| 4,897,941 | A * | 2/1990 | Sinykin | E01H 4/02 172/684.5 |
| 5,077,919 | A * | 1/1992 | Sinykin | E01H 4/02 37/219 |
| D459,733 | S * | 7/2002 | Lassonde | A01B 1/02 D15/11 |
| 7,584,557 | B1 | 9/2009 | Nistler | |
| D617,350 | S * | 6/2010 | Cummings | E01H 10/007 D15/11 |
| 9,611,604 | B2 * | 4/2017 | Vigneault | E01H 5/062 |
| 2004/0006894 | A1 | 1/2004 | Schultz et al. | |
| 2004/0006895 | A1 | 1/2004 | Schultz et al. | |
| 2004/0060201 | A1 | 4/2004 | Schultz et al. | |
| 2008/0052929 | A1 | 3/2008 | Paonessa | |
| 2009/0307934 | A1 | 12/2009 | Wendorff et al. | |
| 2011/0287203 | A1 | 11/2011 | Victor et al. | |
| 2011/0287223 | A1 | 11/2011 | Victor et al. | |
| 2011/0311769 | A1 | 12/2011 | Chen et al. | |
| 2013/0161152 | A1 | 6/2013 | Wing | |

OTHER PUBLICATIONS

Wenpeng Jiang, "Bio-mimetic surface structuring of coating for tribological applications," vol. 201, Issue 18, Jun. 25, 2007, pp. 7889-7895.

M.A. Al-Bukhaiti, "Tribological and mechanical properties of TI/TiAIN/TIAICN nanoscale multilayer PVD coatings deposited on AISI H11 hot work tool steel", vol. 318, Nov. 1, 2014, pp. 180-190.

Steele, Adam, et al., "Linear abrasion of a titanimum superhydrophobic surfact prepared by ultrafast lase microtexturing," Journal of Miromechanics and Microengineering, vol. 23, Isssue 11, Article id.115012 (2013), number of pages 8.

Voile Vector BC Ski, Allspeed Cyclery & Snow, posted on Nov. 2, 2011 by Allspeed Team, 3 pages.

* cited by examiner

WEAR-RESISTANT COATING

CROSS-REFERENCE TO RELATED APPLICATIONS

The present application claims the benefit of U.S. Provisional Application Ser. No. 62/287,698, filed on Jan. 27, 2016, 2015, titled WEAR-RESISTANT COATING, the disclosure of which is incorporated herein by reference in its entirety.

TECHNICAL FIELD

The present invention relates generally to plowing systems and wear resistant coatings for plowing systems.

BACKGROUND OF THE INVENTION

Plowing vehicles, such as snowplowing vehicles, generally have a curved, shovel like device commonly known as a moldboard disposed on the front, side, underneath, and/or rear of the vehicle. A plow blade is generally removably attached to a lower portion of the moldboard. The plow blade acts as the cutting edge by scraping along the upper surface of a roadway to remove snow or other materials from the roadway. The plowing system is generally held in contact with the road surface by the weight of plowing system and by the support members attaching the moldboard to the plowing vehicle.

Contact with the hard and rough road surface can cause damage to the plow blade, mold board, and other components over time. Further, certain portions of the plowing system may wear more quickly than others due to various factors beyond the control of a plow vehicle operator such as uneven or crowned roadways or the plow blade striking objects in or on the roadway.

To reduce damage to large components, expensive components, and components that are more difficult to replace, some plowing systems sometimes include sacrificial parts designed to prohibit damage to the more expensive components and are replaced when they are worn down from use. For example, shoes may be disposed behind the plow blade to support the weight of the plow blade. These shoes are easily replaceable and ride along the road surface to prevent damage to the plow system. In existing plowing systems, however, these shoes generate considerable friction with the road surface. The friction in turn produces heat that accelerates the wear of the shoes. The interaction of the shoe and the rough surface of the road also causes vibration, further exacerbating the wear of the shoes.

SUMMARY

Exemplary embodiments of plows, plow components, and other apparatus having a wear-resistant coating are disclosed herein.

An exemplary plow includes a moldboard having a wear surface and a blade having a wear surface. A wear resistant coating is applied to at least a portion of at least one of the wear surfaces of the blade and moldboard. The wear resistant coating includes a plurality of scales. Each scale has a leading edge, a trailing edge, a raised portion disposed between the leading edge and the trailing edge, and a peak of the raised portion disposed closer to the trailing edge than the leading edge. The scales of the wear resistant coating are arranged in a plurality of rows, and gaps formed between scales in one row are offset from gaps formed between scales in an adjacent row.

An exemplary plow component has a wear surface. A wear resistant coating is applied to at least a portion of the wear surface of the plow component. The wear resistant coating includes a plurality of scales. Each scale has a leading edge, a trailing edge, a raised portion disposed between the leading edge and the trailing edge, and a peak of the raised portion disposed closer to the trailing edge than the leading edge. The scales of the wear resistant coating are arranged in a plurality of rows, and gaps formed between scales in one row are offset from gaps formed between scales in an adjacent row.

An exemplary apparatus has a wear surface. A wear resistant coating is applied to at least a portion of the wear surface of the apparatus. The wear resistant coating includes a plurality of scales. Each scale has a leading edge, a trailing edge, a raised portion disposed between the leading edge and the trailing edge, and a peak of the raised portion disposed closer to the trailing edge than the leading edge. The scales of the wear resistant coating are arranged in a plurality of rows, and gaps formed between scales in one row are offset from gaps formed between scales in an adjacent row.

BRIEF DESCRIPTION OF THE DRAWINGS

These and other features and advantages of the present invention will become better understood with regard to the following description and accompanying drawings in which.

DETAILED DESCRIPTION

This Detailed Description merely describes exemplary embodiments of the invention and is not intended to limit the scope of the claims in any way. Indeed, the invention as claimed is broader than the exemplary embodiments, and the terms used in the claims have their full ordinary meaning, unless a limiting definition is expressly provided herein.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of). As described herein, the term "scale" refers to a protrusion or bump formed on a surface by shaping the surface or by affixing a member to the surface.

The wear resistant coating of the present invention is described below as applied to wear surfaces of a plowing system, though the wear resistant coating may be applied to any apparatus or system that includes wear surfaces requiring protection from impact, abrasion, and/or wear. For example, the wear resistant coating may be applied to a surface that from time to time comes into contact with heavy and/or hard objects. As another example, the wear resistant coating may be applied to surfaces of components in a system that frequently contact or rub together.

Figure 1:
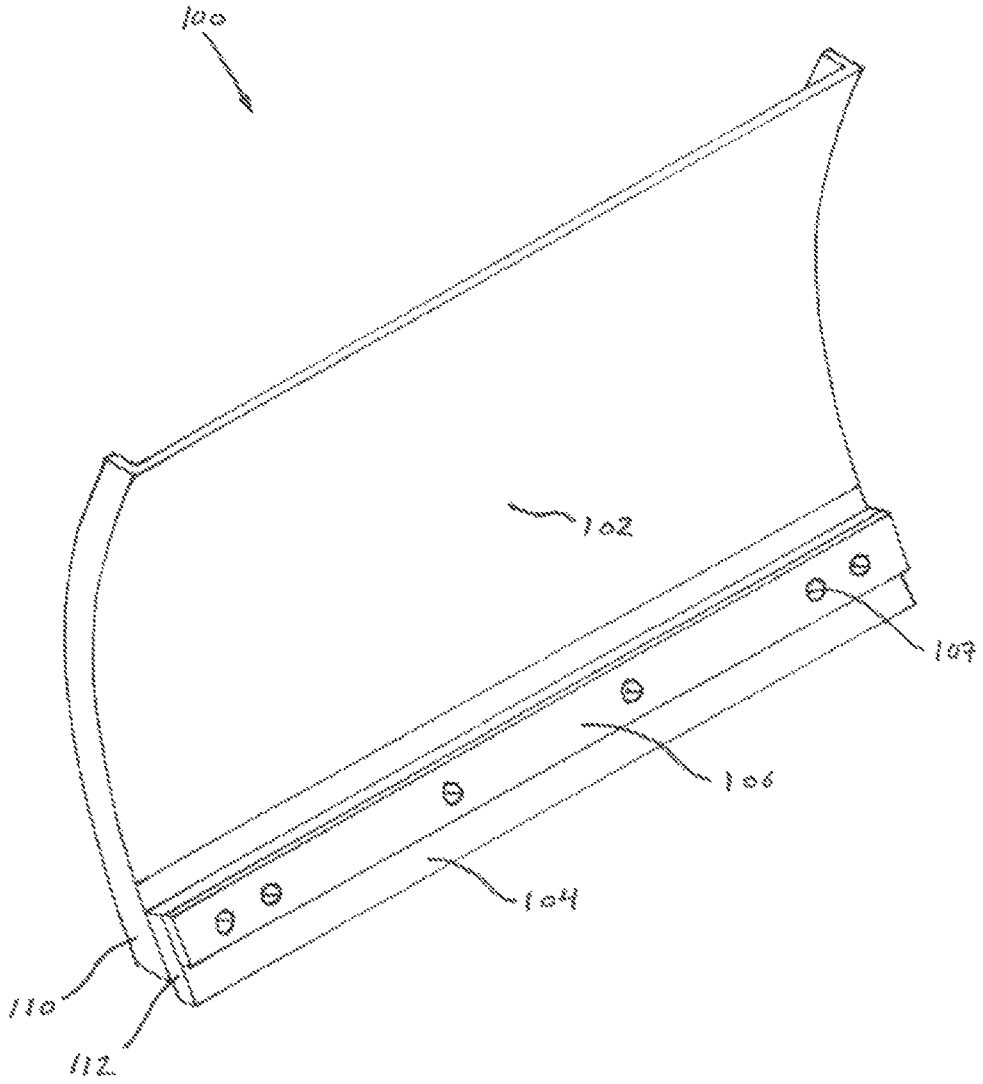
FIG. 1 illustrates a top-front perspective view of a plow system.
Figure 2:
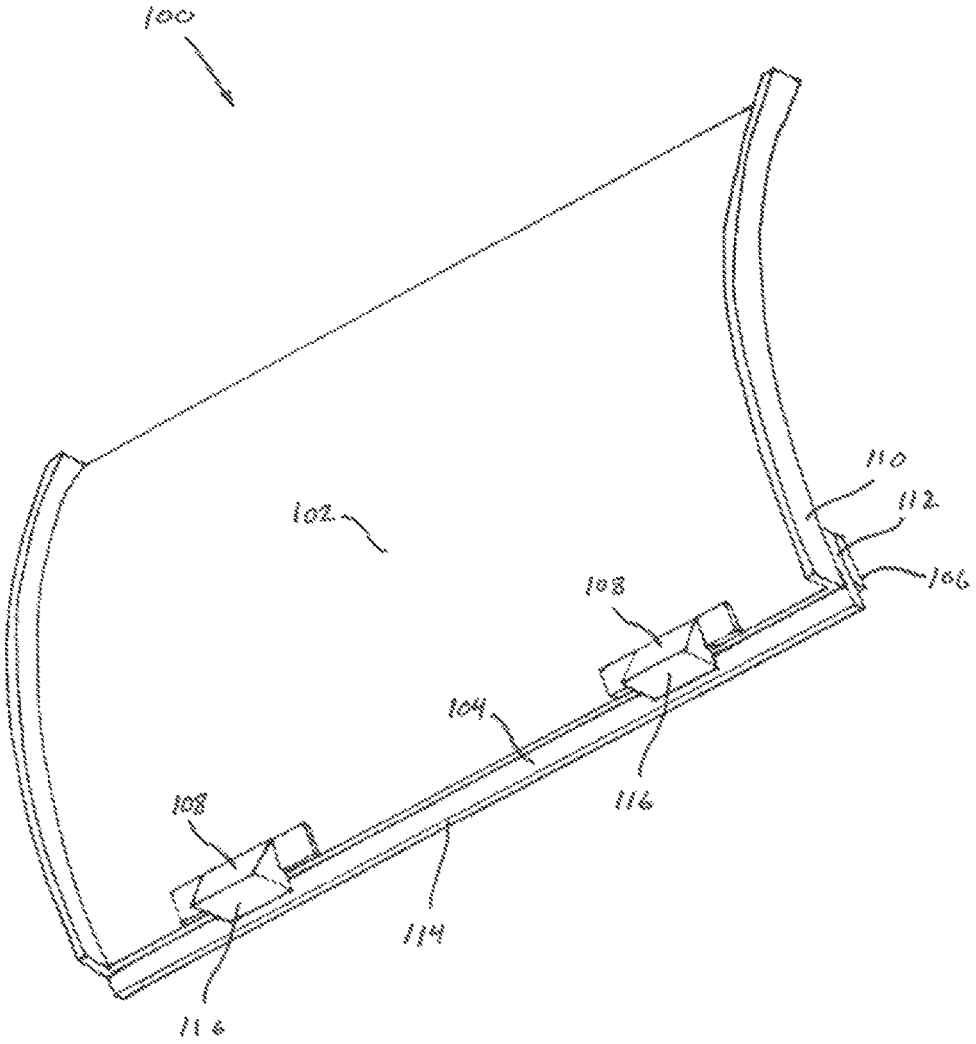
FIG. 2 illustrates a bottom-rear perspective view of the plow system of FIG. 1.

Referring now to FIGS. 1 and 2, an exemplary plowing system 100 is shown. The plowing system 100 includes a mold board 102, a plow blade 104, a blade retaining member 106, and shoes 108. The blade 104 is secured to the mold board 102 by the blade retaining member 106 and a plurality of fasteners 107. The shoes 108 are attached to the rear of the mold board 102 and can be adjusted to raise or lower the blade 102 relative to the road surface being plowed. In the exemplary plowing system 100, the shoes 108 are sacrificial wear parts designed to reduce wear to the moldboard 102 and blade 104.

The plowing system 100 includes a variety of surfaces that come into contact with the road surface, curbs, or the like during use, if not shielded by a sacrificial wear part or guard. These surfaces include the side surface 110 of the mold board 102 and the side and bottom surfaces 112, 114 of the blade 104. Wear parts or guards (not shown) may be attached to the side surface 110 of the moldboard 102, or the side and bottom surfaces 112, 114 of the blade 104 to protect them from damage. An exemplary scale patterned wear resistant coating is applied to the wear parts or guards and to the bottom surface 116 of the shoes 108. In some embodiments, the scale patterned wear resistant coating is applied directly to the components of the plowing system, such as, for example, all surfaces of the blade 104.

The scale patterned wear resistant coating of the present application applied to wear parts protects surfaces of the plowing system from damage during plowing of the road surface while simultaneously reducing friction and hydraulic drag. The reduced friction leads to a reduction in heat generated by contact with the road surface, thereby leading to a longer life for the components of the plowing system. The wear resistant coating is generally comprised of hardened steel, carbide, tungsten, ceramics, hard-surfacing wire, nano-structures, bonding agents, and the like. This material is hard enough to resist damage from the road surface, thereby maintaining the scale pattern of the coating. For example, the coating may have a hardness of about 40 to about 80 on the Rockwell C hardness scale. In some embodiments, the wear resistant coating includes a self-healing material.

The scale patterned wear resistant coating also helps protect the road surfaces being plowed. Wear damage of the plow blade creates an uneven and jagged surface that unevenly distributes the weight of the plow system to the road surface. The weight of the plow is focused on the high points of the plow blade edge which can result in gouging of the road surface and/or damage to coatings on the road surface, such as, for example, paint. The scale patterned wear resistant coating distributes the weight of the plow across a the scales of the pattern to prevent gouging and other damage to the road surface.

Figure 3:
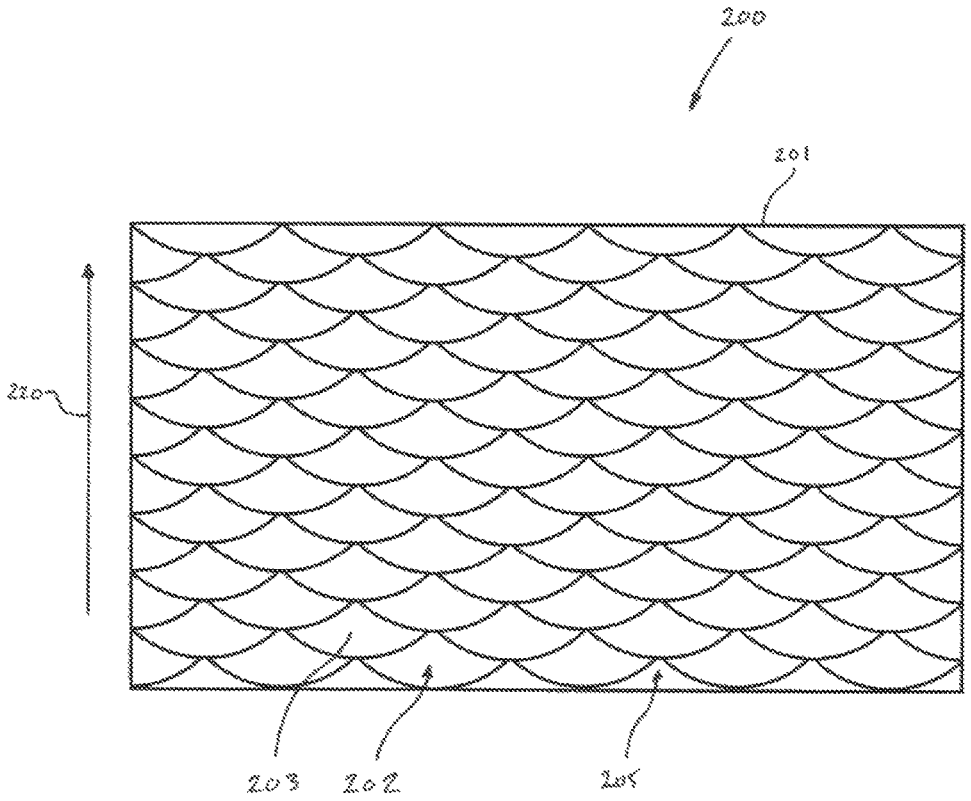
FIG. 3 illustrates a portion of an exemplary wear surface having an exemplary scale patterned wear resistant coating.
Figure 4:
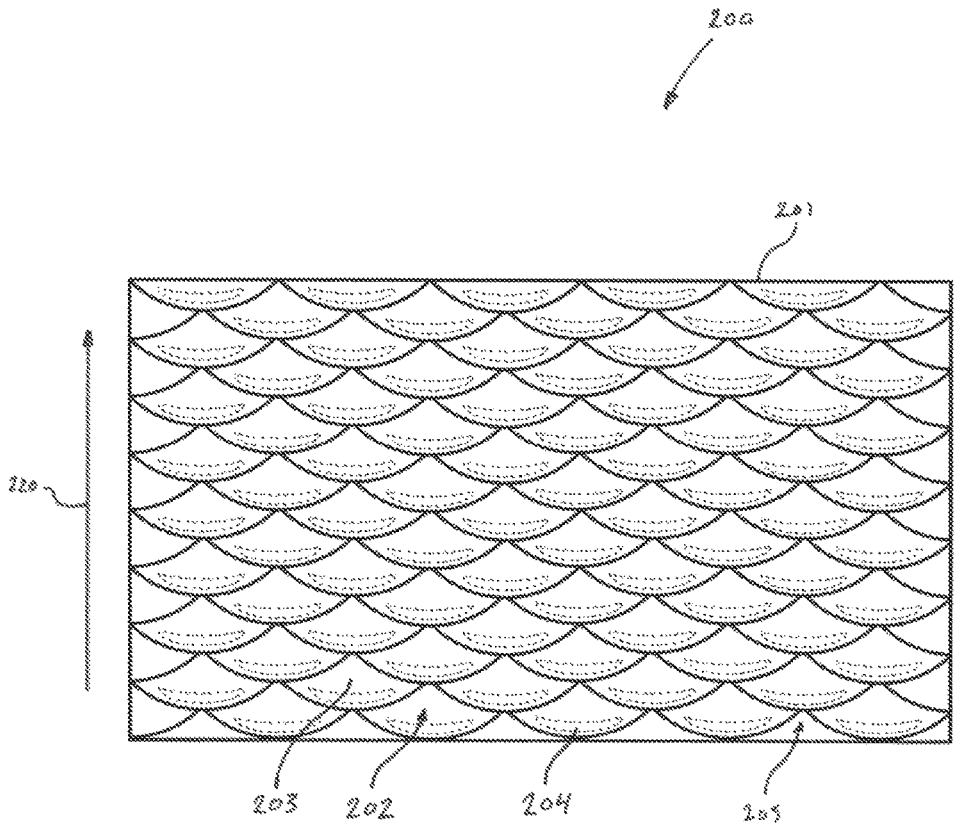
FIG. 4 illustrates the contact zones of the exemplary wear surface of FIG. 3.
Figure 5:
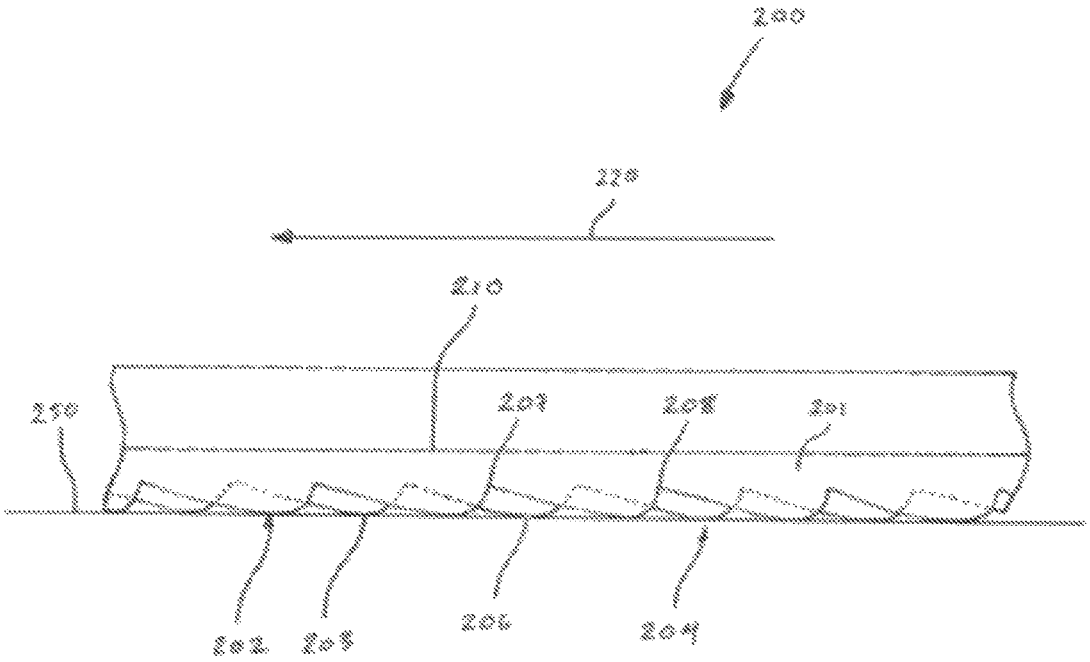
FIG. 5 illustrates a cross-section of a portion of the wear surface of FIG. 3.

Referring now to FIGS. 3-5, an exemplary wear resistant component 200 having a scale patterned wear resistant coating 201 is shown. The coating is applied to a wear surface 210 of the component 200. The wear surface 210 is a surface that typically experiences wear during use, such as, for example, the bottom surface 116 of the shoes 108 described above.

The exterior surface 202 of the wear resistant coating 201 includes a plurality of scales 203 that form a "fish scale" like pattern. The scales 203 are rounded at their trailing edge, i.e., the edge at the back of the scale 203 as the component 200 is moved in the direction of the arrow indicating a direction of travel 220. In the illustrated embodiment, adjacent rows of the scales 203 are offset or staggered so that the gaps 205 between scales 203 of one row are not aligned with gaps 205 of an adjacent row.

As can be seen in the cross-sectional view of FIG. 5, each scale 203 includes a raised portion 206 between its leading and trailing edges 207, 208. Additionally, each scale 203 is tapered, i.e., the peak of the raised portion 206 is closer to the trailing edge 208 than the leading edge 207 so that the scales tend to increase in height from the leading to trailing edge 207, 208. The peaks of the scales 203 are rounded and form a contact zone 204 where the scale 203 meets a hard surface 250, such as, for example, a road surface. The contact zone 204 is about 10% to about 50% of the surface area of the wear resistant coating 201. That is, the sum of all of the contact zones 204 of the scales 203 is equal to about 10% to about 50% of the entire surface area of the wear coating 201. The friction between the road surface 250 and the component 200 is reduced significantly by the reduction in the surface area of the component 200 contacting the road surface 250.

In addition to reducing mechanical friction with the road surface 250, the scale pattern of the wear resistant coating 201 reduces hydrodynamic drag caused by water on the road surface 250. As the component 200 is driven across the road surface 250, the space between the road 250 and the scales 203 form channels through which the water can flow. These channels extend between the gaps 205 between each scale 203, running along the trailing edge of each scale. Thus, as viewed from the perspective of FIG. 4, the channels form a "zigzag" -like pattern as the water flows through around and between the scales 203.

Figure 6A:
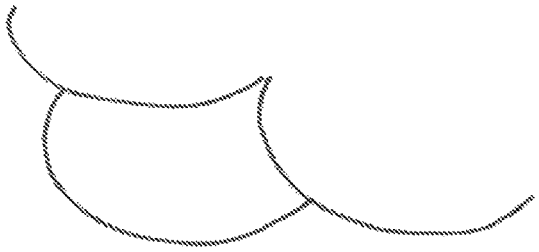
FIGS. 6A, 6B, and 6C illustrate various scale shapes that may be used on an exemplary wear surface.
Figure 6B:
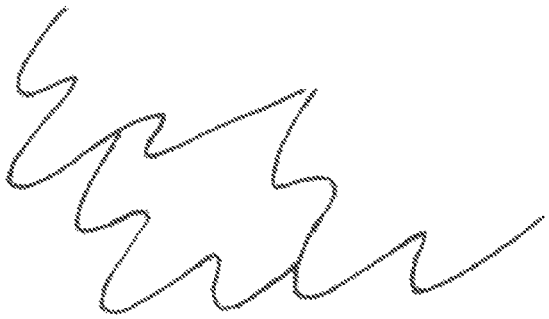
Figure 6C:
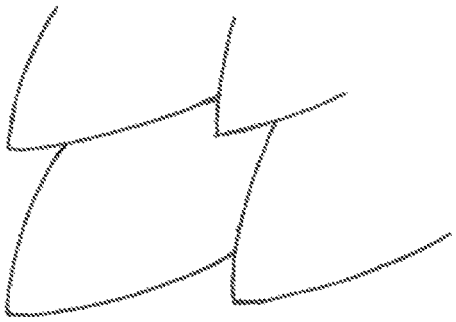

Referring now to FIGS. 6A-6C, three different exemplary "fish scale"-like shapes are shown. The scale shape shown in FIG. 6A is similar to that shown in FIGS. 3-5. The scales of FIG. 6B have a shape of a scale of a shark. The scale of FIG. 6B has three lobes or teeth at its trailing edge, and three ridges along the scale align with these teeth. The scales of FIG. 6C are pointed rather than round, and narrower than they are long. The various scale shapes and patterns shown in FIGS. 6A-6C are only a few of the many scale shapes that may be used in the present invention, depending on the particular application for the wear resistant surface and the environment in which it is to be used.

In addition to varying the scale shape, the length, width, and height of each scale may be varied depending on the desired application. These variables may be varied from scale to scale as well, so that different areas of the wear resistant coating have different characteristics. For example, smaller scales may be used on a smaller wear surface, and larger scales on a larger wear surface. The size of the scales may also be increased or decreased as the weight of the component changes. For example, some scale shapes may increase performance when small scales are used on a heavy object, while other scale shapes may increase performance when larger scales are used for heavier objects. As the size of the scales change, the total area of the contact zones varies as a proportion of the surface area of the coating, thereby reducing or increasing the friction between the wear coating and any surface engaged with the wear coating. Additionally, grooves may be formed between adjacent scales to provide further space for liquids to flow.

Figure 7A:
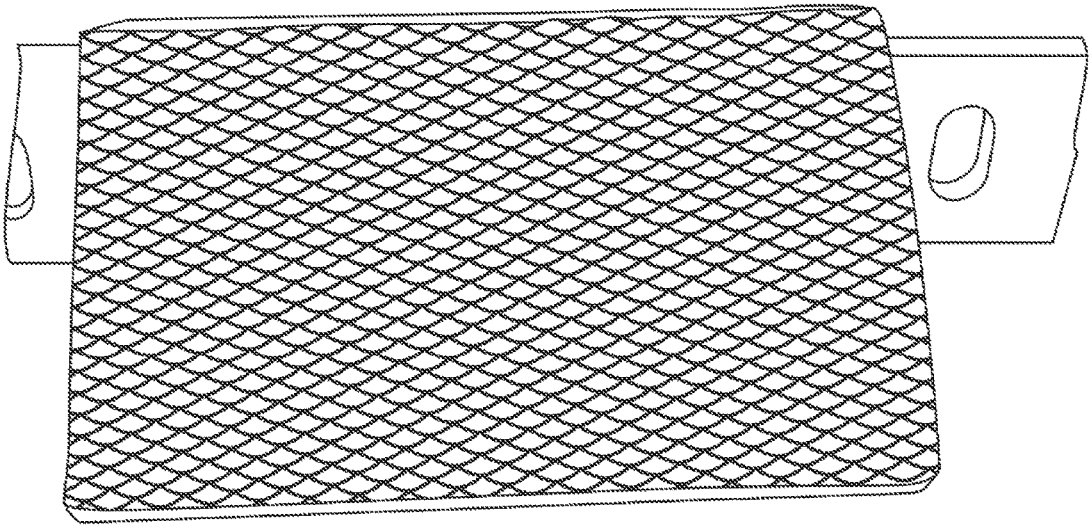
FIGS. 7A and 7B are photographs of exemplary shoes of a plowing system having an exemplary scale patterned wear resistant coating.
Figure 7B:
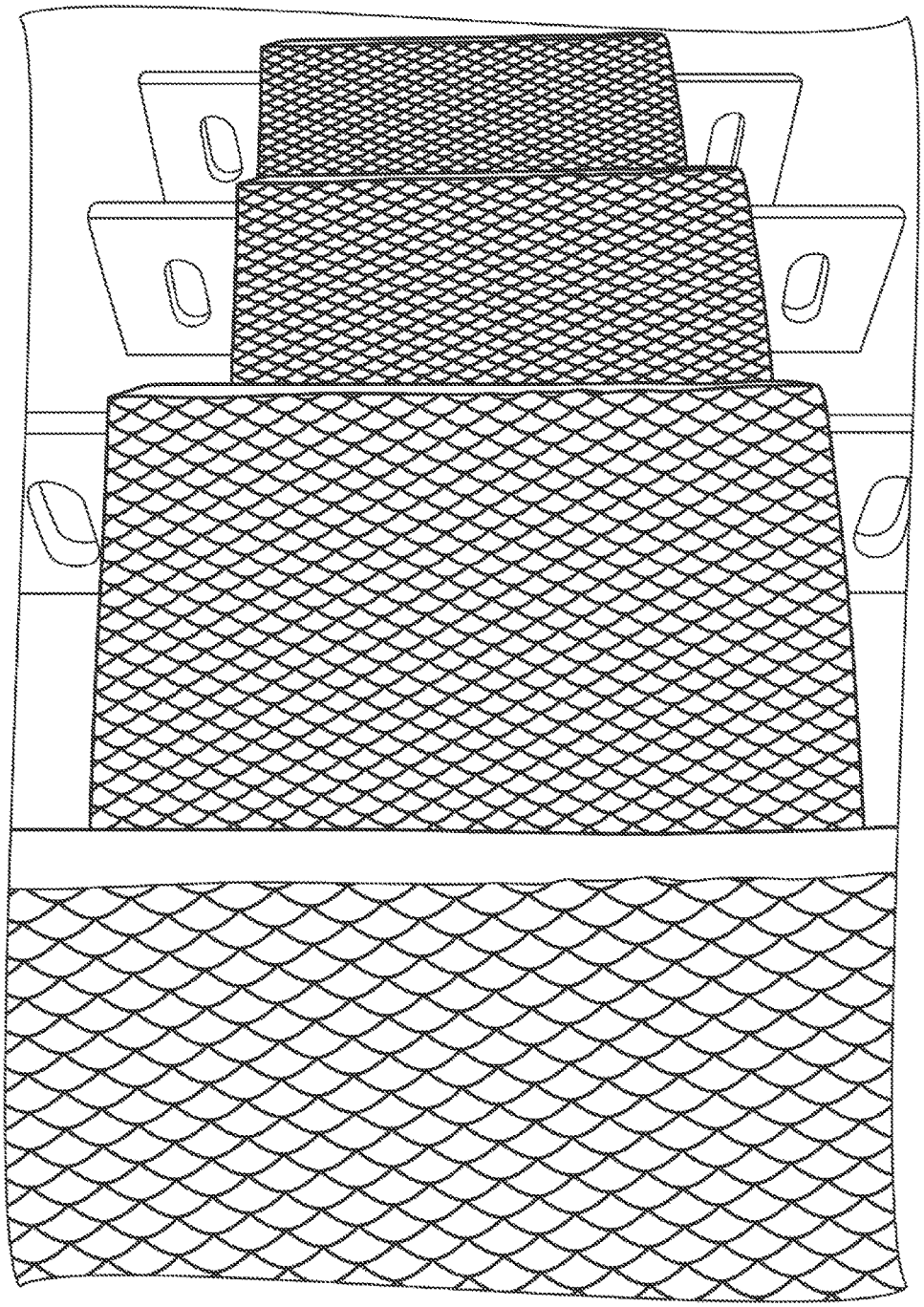

Referring now to FIGS. 7A and 7B, photographs of snow plow shoes are shown having an exemplary wear resistant coating applied to the bottom surface that rides on the road. The wear resistant coating has a scaled pattern that is similar to the exemplary coating illustrated in FIG. 4.

Figure 8A:
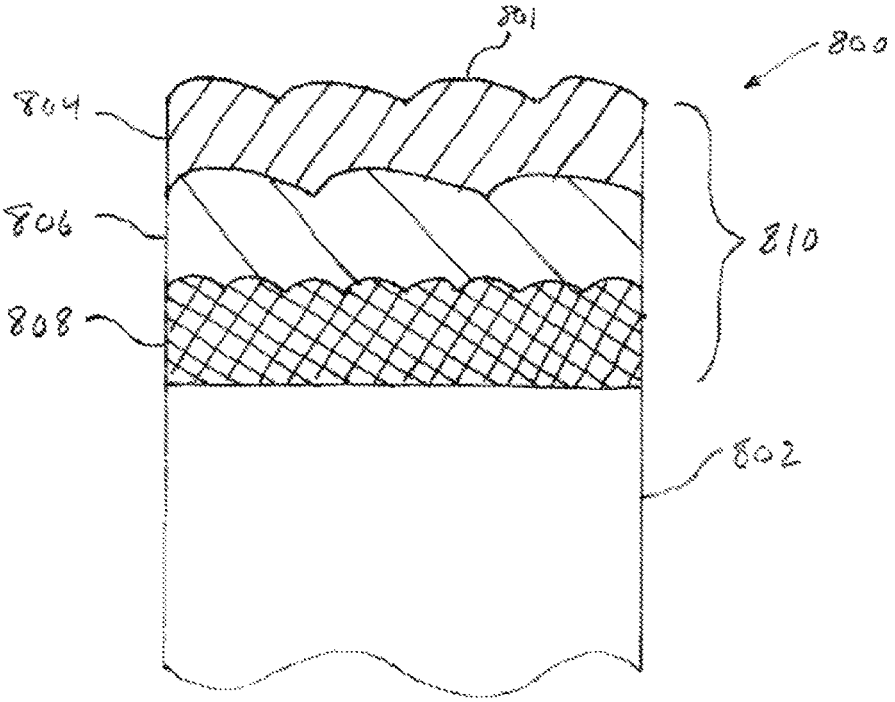
FIGS. 8A and 8B illustrate cross-sections of exemplary layered wear resistant coatings.
Figure 8B:
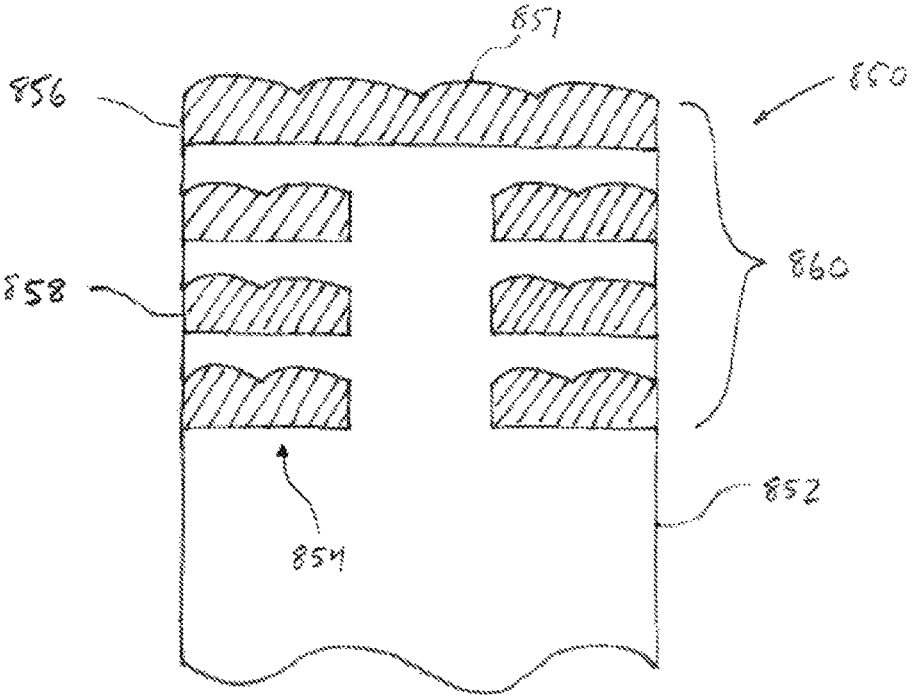

Referring now to FIGS. 8A and 8B, cross-sections of exemplary wear resistant components 800 and 850 having layered wear resistant coatings are shown. Wear resistant component 800 includes a metal base 802 and a plurality of layers 804, 806, 808 are bonded together to form the scale patterned wear resistant coating 810. Though three layers are shown, the layered wear resistant coating 801 may have any number of layers. Each of the layers 804, 806, 808 covers the layer below. Each layer 804, 806, 808 is formed of a different material so that the wear resistant coating 810 exhibits different characteristics over time. For example, the outermost layers may be softer than the inner layers, or vice versa. A pattern of scales 801 may be formed in some or all of the layers 804, 806, 808. In some embodiments, a scale pattern is only formed in the surface layer 804 and the lower layers 806, 808 are non-scaled layers. Non-scaled layers may include other coatings, such as other wear resistant coatings. As shown, the scales 801 of each layer 804, 806, 808 have different sizes. The shape of the scales may vary from layer to layer, or the scales may be the same size and shape in every layer. In some embodiments, the size and shape of the scales varies depending on the material used to make the layer. In certain embodiments, the layers 804, 806, 808 of the wear resistant material may be about ⅛ inch thick to about 1 inch thick.

Wear resistant component 850 includes a metal base 852 and a wear portion 860. The wear portion 860 includes a full layer 856 and a plurality of partial layers 858 formed in grooves 854 formed in the sides of the metal base 852. In some embodiments, the full layer 856 is formed by a plurality of layers, such as the layers 804, 806, 808 shown in FIG. 8A. The partial layers 858 are exposed as the metal base 852 wears away, thereby slowing the wear of the metal base 852 as the layers 856, 858 are formed of a harder material than the metal base 852. The layers 856, 858 may be formed of the same materials or of different materials. The scales 851 may be all the same size and shape or may vary between layers. In some embodiments, a scale pattern is only formed in the full layer 856 and the partial layers 858 are non-scaled layers. Non-scaled layers may include other coatings, such as other wear resistant coatings. In some embodiments, the scales in one portion of a partial layer are different in size and/or shape from scales in another portion of a partial layer, such as, for example, in grooves 854 on different sides of the component 850. In certain embodiments, the layers 856, 858 of the wear resistant material may be about ⅛ inch thick to about 1 inch thick.

While the exemplary scale patterned wear resistant coating has been shown on components of a snow plowing system, it is contemplated that the coating will provide equivalent benefits on other wear surfaces. In addition, the wear resistant coating may be used on convex or concave surfaces. Furthermore, the scale pattern may be oriented differently on different surfaces to produce a desired flow pattern of the water over a wear surface, such as, for example, causing the water to move to the outer edge of a plow, thereby reducing the amount of water in the middle of the road.

The scale patterned wear resistant coating is bonded to the wear surface and the pattern in the coating may be formed through the use of a mold, a spray pattern, machining, the shape of the base material, a filter, a mask, or the like. The scale patterned wear resistant coating has a thickness ranging from about 0.0001 inches to about 2 inches. An additional friction reducing layer, such as, for example, a Teflon layer, may also be formed on the wear resistant coating.

In some exemplary embodiments, the scale patterned wear resistant coating 201 is molded (or otherwise formed, e.g., milled from a piece of material) as a single unitary piece from hardened steel, carbide, tungsten, hard surfacing wire, ceramics, or the like. In the alternative, the exemplary scale patterned wear resistant surface herein can be molded or otherwise formed in a plurality of parts that are affixed, e.g., individual scale components may be adhered, welded, or otherwise affixed to a base layer. In some exemplary embodiments, the exemplary scale patterned wear surface includes a bonding agent to bond various materials together, e.g., nano-structures or ceramics.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, by increasing or decreasing the size of the scales. Accordingly, departures can be made from such details without departing from the spirit or scope of the applicant's general inventive concept.

What is claimed is:

1. A plow comprising:

a moldboard having a wear surface;

a blade having a wear surface; and a wear resistant coating applied to at least a portion of at least one of the wear surfaces of the blade and moldboard, the wear resistant coating comprising a plurality of scales, the scales comprising:

a leading edge;

a trailing edge;

a raised portion disposed between the leading edge and the trailing edge; and a peak of the raised portion disposed closer to the trailing edge than the leading edge;

wherein scales of the wear resistant coating are arranged in a plurality of rows; and wherein gaps formed between scales in one row are offset from gaps formed between scales in an adjacent row.

2. The plow of claim 1, further comprising:

at least one guard attached to at least one of the moldboard and the blade, the guard having a wear surface;

wherein the wear surface of the at least one guard is coated with the wear resistant coating.

3. The plow of claim 2, wherein the at least one guard comprises a shoe attached to a bottom portion of the moldboard.

4. The plow of claim 1, wherein the wear resistant coating is formed of at least one of hardened steel, carbide, tungsten, ceramic, hard-surfacing wire, nano-structures, and a bonding agent.

5. The plow of claim 1, wherein the wear resistant coating comprises a self-healing material.

6. The plow of claim 1, wherein the wear resistant coating has a hardness in a range of about 40 Rockwell C to about 80 Rockwell C.

7. The plow of claim 1, wherein the wear resistant coating has a thickness in a range of about 0.0001 inches to about 2 inches.

8. The plow of claim 1, wherein the wear resistant coating has a thickness in a range of about 0.12 inches to about 1 inch thick.

9. The plow of claim 1, wherein the wear resistant coating is formed of a plurality of layers.

10. The plow of claim 9, wherein each of the plurality of layers comprises a plurality of scales.

11. The plow of claim 9, wherein a first material of at least one of the plurality of layers is different from a second material of at least another of the plurality of layers.

12. The plow of claim 9, wherein more than one of the plurality of layers is disposed at an outer surface of the wear resistant coating.

13. The plow of claim 9, wherein at least one of the plurality of layers is a partial layer.

14. The plow of claim 1, wherein:

the peak of each scale comprises a contact zone; and a total contact area of all of the contact zones comprises about 10% to about 50% of a total surface area of the wear resistant coating.

15. The plow of claim 1, further comprising a friction reducing layer disposed on an external surface of the wear resistant coating.

16. The plow of claim 1, wherein:

the trailing edge of each scale comprises a point; and a length of the scale is greater than a width of the scale.

17. The plow of claim 1, wherein:

the trailing edge of each scale comprises a plurality of lobes;

each scale further comprises a plurality of peaks; and each peak is aligned with a lobe of the trailing edge.

* * * * *